US005092701A

United States Patent [19]

Lai

[11] Patent Number: 5,092,701

[45] Date of Patent: Mar. 3, 1992

[54] PEN DEVICE TO PREVENT INK FROM BEING VAPORIZED

[76] Inventor: Kung-Jong Lai, 100-1, Sec. 2, Ho Pen West Rd., Taipei, Taiwan

[21] Appl. No.: 419,469

[22] Filed: Oct. 10, 1989

[51] Int. Cl.[5] ..... B43K 9/00

[52] U.S. Cl. ..... 401/107; 401/108; 401/109; 401/116

[58] Field of Search ..... 401/107, 108, 116, 109

[56] References Cited

U.S. PATENT DOCUMENTS

| | | | |
|---|---|---|---|
| 2,949,887 | 8/1960 | Martin et al. | 401/108 |
| 2,957,452 | 10/1960 | Brannon | 401/108 |
| 3,039,436 | 6/1962 | Exner | 401/108 X |
| 4,479,732 | 10/1984 | Shimizu | 401/108 X |

FOREIGN PATENT DOCUMENTS

| | | | |
|---|---|---|---|
| 1284326 | 11/1968 | Fed. Rep. of Germany | 401/107 |
| 612885 | 8/1979 | Switzerland | 401/108 |

*Primary Examiner*—Steven A. Bratlie

*Attorney, Agent, or Firm*—Esso International Patent & Trademark Office

[57] ABSTRACT

A writing pen having a retractible ink tube and a series of sealing disks for sealing the writing nib against vaporization or drying of ink on the nib surface when the ink tube is in its retracted position. A sliding sleeve is mounted around the ink tube to separate the ink tube from the seal assembly so as to prevent the ink from contaminating the seal assembly.

2 Claims, 3 Drawing Sheets

PEN DEVICE TO PREVENT INK FROM BEING VAPORIZED

BACKGROUND OF THE INVENTION

The conventional writing pen or white-board pen has to be covered with a pen cap when not in use so as to prevent the ink tube from being exposed to the air to vaporize the ink; otherwise the ink on the pen nib would be dried up to prevent the pen from writing normally. Some users often forget to put the pen cap on a pen after writing; after several days, the pen cap is lost, and the ink tube of the pen is exposed to the air to thus clog the pen.

SUMMARY OF THE INVENTION

This invention provides a pen with an ink-anti-vaporizing device. The pen according to the present invention does not require a pen cap and the ink reservoir in the pen can easily be replaced.

Another feature of the present invention is that there is special seal assembly and a seal ring installed inside the pen holder. A sealed chamber is formed for maintaining the ink tube and the ink nib in a closed condition. When the pen is to be used for writing purposes the ink tube may be pushed out of the seal assembly. When the ink tube is later pulled back into the seal chamber, the ink tube is in a sealed condition spaced axially from the seal assembly. Within the seal chamber there is a sliding sleeve surrounding the ink tube; the inner surface of the sliding sleeve is furnished with several small beads or gripper elements which have a friction fit against an annular protuberance formed on the ink tube. The sliding sleeve acts as a movable shield to prevent the ink tube from touching the seal assembly.

A further feature of the present invention is that the seal assembly includes two soft rubber disks, each of which is furnished with a Y or X-shaped slit, and one additional soft foam rubber disk between the aforesaid two disks. The aforesaid three soft disks can provide an elastic and seal function for the ink tube, i.e., after the ink tube has been pulled back into the seal chamber; the ink nib will be located within the seal chamber, with the three soft rubber disks forming an air seal to prevent the ink from being vaporized or dried.

DETAILED DESCRIPTION

Figure 1:
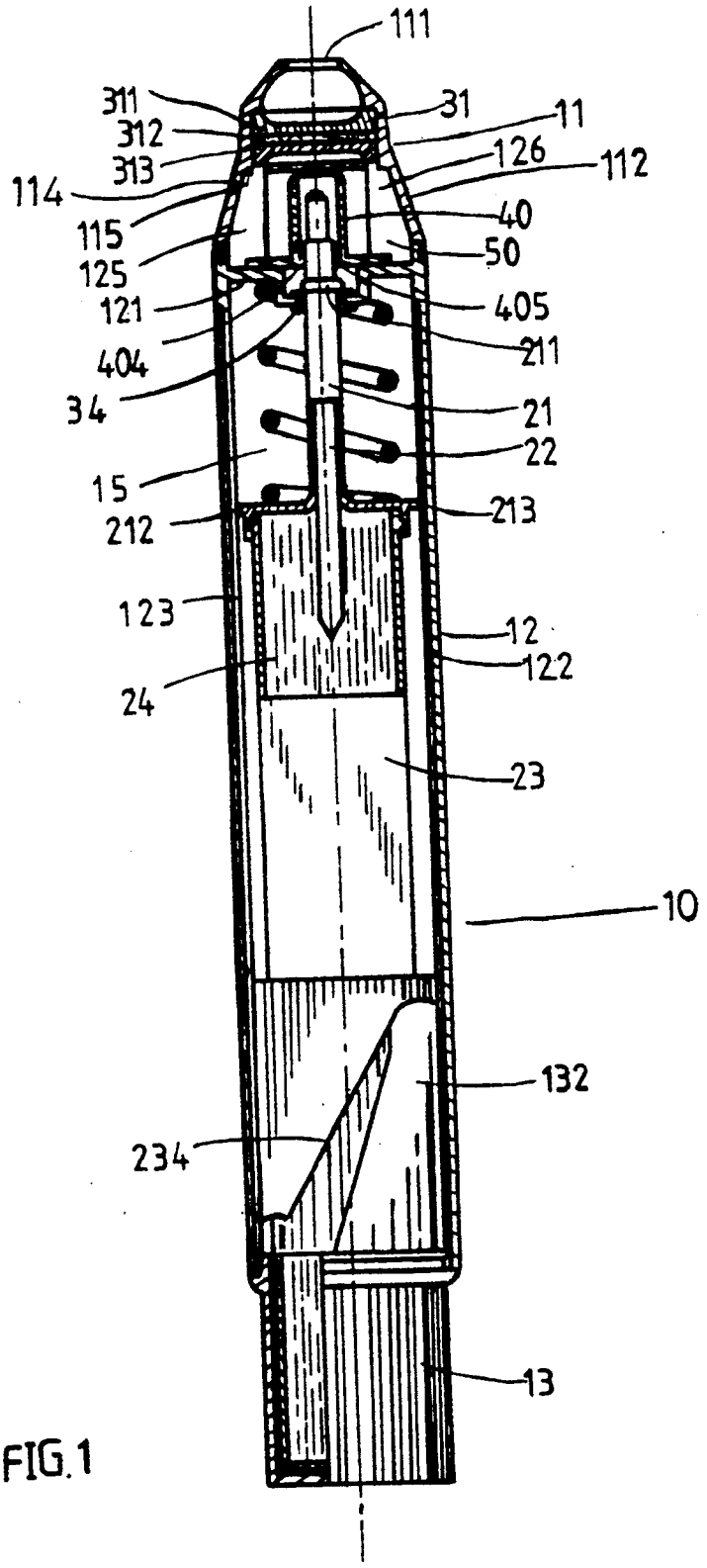
FIG. 1 is a sectional view taken through one embodiment of the present invention.
Figure 2:
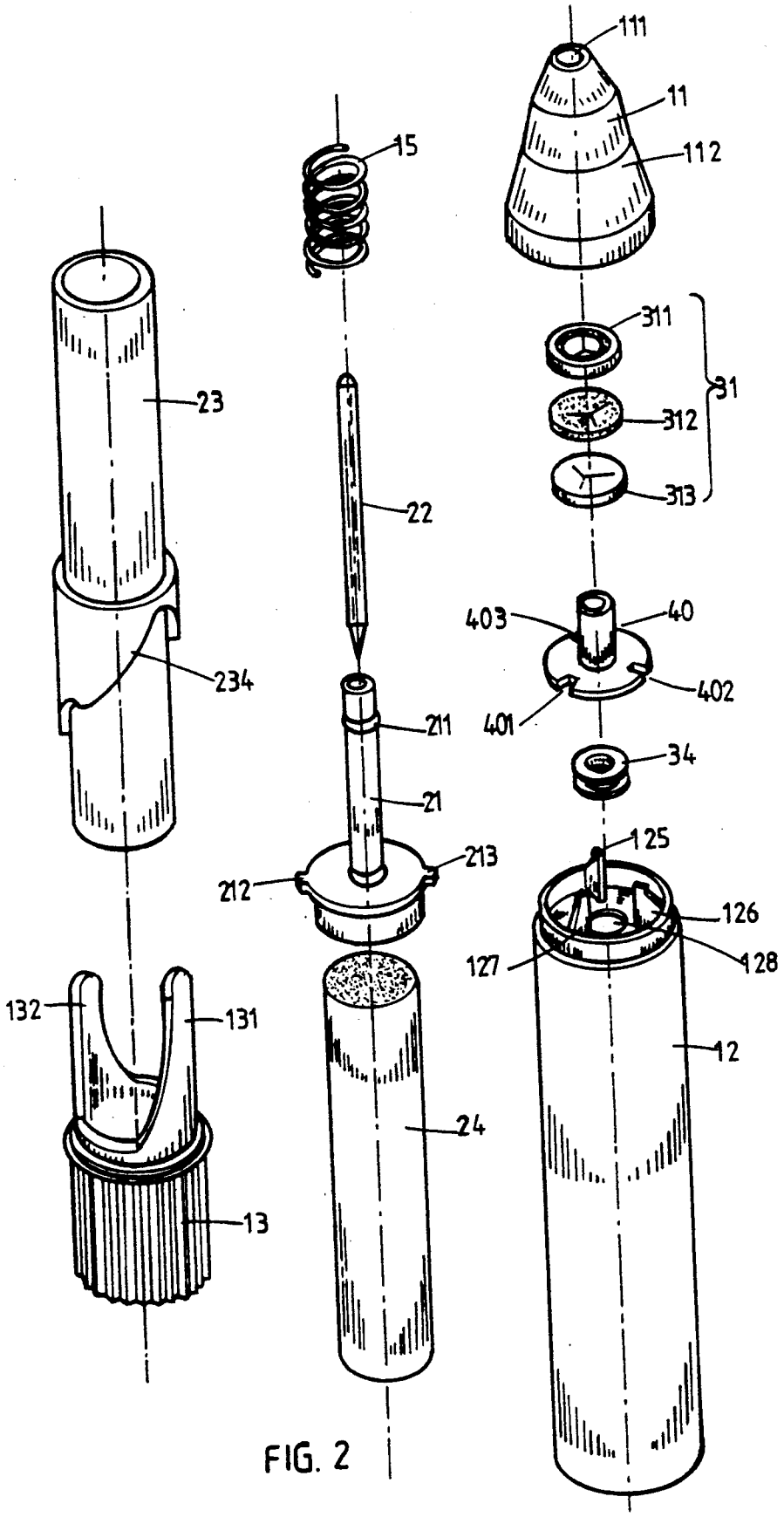
FIG. 2 is a disassembled exploded view of the FIG. 1 assembly.
Figure 3:
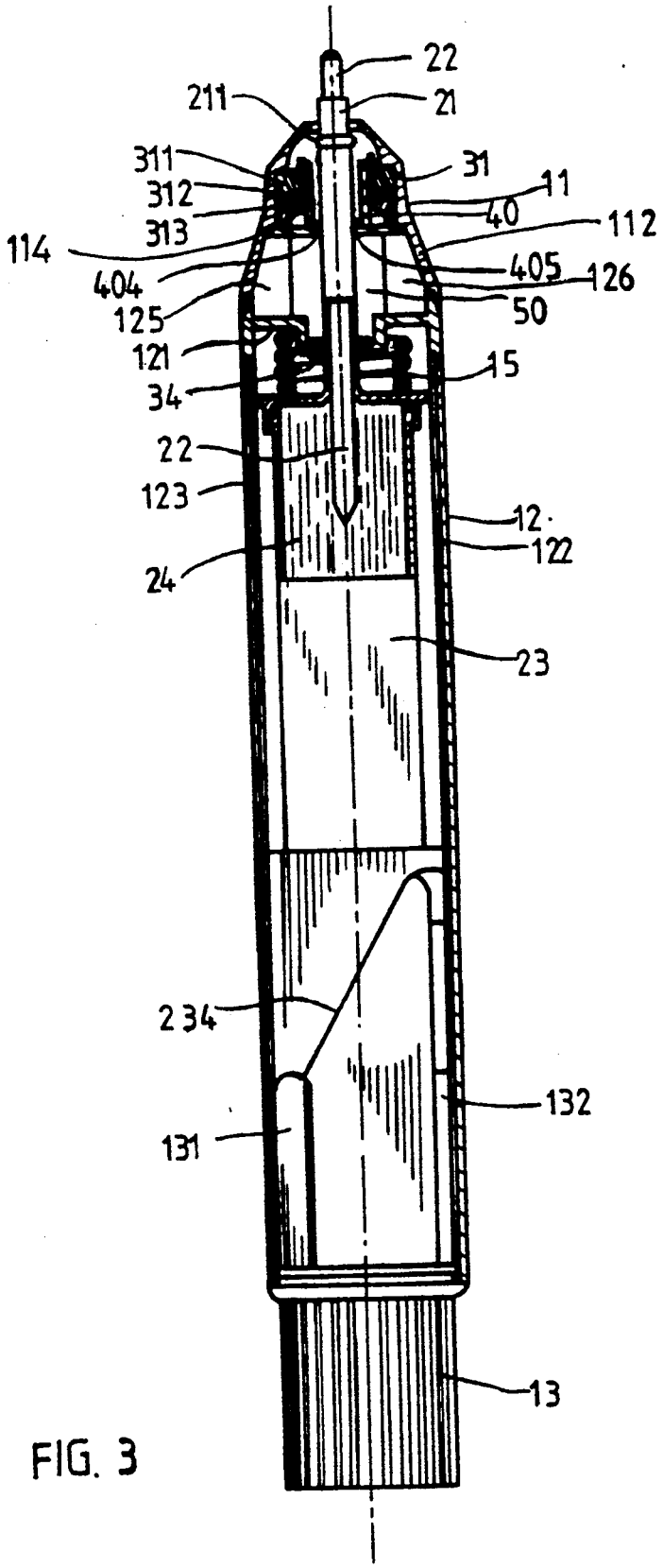
FIG. 3 is another sectional view of the FIG. 1 assembly, showing the ink nib being pushed out for writing purposes.

Referring to FIG. 1, there is shown a pen according to the present invention, said pen comprising a front pen socket 11, a tubular pen holder 12 and a pen rear cap 13. The top of the front pen socket 11 has a through hole 111. Inside the hollow pen holder 12 there are a partition plate 121 and two guide grooves 122 and 123 on the inner wall thereof. The rear part of the pen comprises a rotary cap 13, which has two fork-shaped cam arms 131 and 132 extending within tubular holder 12 in engagement with cam follower surfaces at 234. The front end of the pen holder 12 has three guide plates 125, 126 and 127. Inside the pen holder 12 there is an ink cartridge assembly that includes an ink tube 21, and ink nib 22, a cylinder 23 and an ink reservoir 24. The upper part of the ink tube 21 has a fixed ring or annular protuberance while the lower part of tube 21 has two symmetrical lugs 212 and 213 movable in grooves 122 and 123. Behind the rear end of the ink tube 21, there is a cylinder 23 loaded with an ink reservoir 24. The outer surface of the cylinder 23 is furnished with an irregular sleeve 234 that defines a cam follower surface cooperable with cam arms 131 and 132. The sealing parts include a seal assembly 31 and a seal ring 34. The seal assembly 31 is installed inside the front pen socket 11, while the seal ring 34 is mounted in a hole in partition plate 121 so as to form a slidable seal around the ink tube 21. The seal assembly 31 includes three soft disks 311, 312 and 313, each of which has a Y-shaped slit extending therethrough. The slits are misaligned in the circumferential direction, as shown in FIG. 2. The upper and lower soft pieces 311 and 313 are made of elastic thin rubber, and the intervening disks 312 is made of a foamed plastic material. There is a sliding sleeve 40, mounted between the seal assembly 31 and the seal ring 34; sleeve 40 has several small beads or gripper elements 404 and 405 on the inner surface thereof. At its lower end the sleeve 40 has an outwardly extending flange that is formed with three radial slots 401, 402 and 403 slidable on guide plates 125, 126 and 127. Sleeve 40 is slidably arranged on ink tube 21 as shown in FIGS. 1 and 3. A coil spring 15 is trained between partition plate 121 and the ink cartridge assembly to normally position tube 21 in a retracted position (FIG. 1)

When the pen is not in use, the sliding sleeve 40 and the ink tube 21 are in a sealed condition in seal chamber 50, as shown in FIG. 1; sealing disks 311, 312 and 313 prevent air flow into chamber 50. When the pen is to be used for writing purposes the rear cap 13 is rotated to let the fork-shaped arms 131 and 132 rotate relative to the irregular cam follower sleeve 234; the ink tube 21 will thus be pushed up-wards to extend out of the seal assembly 31 as shown in FIG. 3. The ink tube 21 can be retracted into the pen by turning the rear cap 13 in the opposite direction; spring 15 returns the ink cartridge assembly to the FIG. 1 position.

When ink tube 21 is pushed forwards (upwards) to penetrate the seal assembly 31, the annular protuberance 211 thereof will be in contact with the small beads 404 and 405 inside the sliding sleeve 40, and the sleeve 40 will be pushed upwardly until the flange on sleeve 40 strikes internal shoulder 114 on the front pen socket 11. After the upper end portion of the sliding sleeve 40 has penetrated through the seal assembly 33, the ink tube 21 continues to move upwards; the annular protuberance 211 on the ink tube will frictionally pass through the small beads 404 and 405 inside the sliding sleeve 40, and then the ink nib 22 will come out of the front pen socket to the writing position (FIG. 3). When the ink tube 21 is later pushed back into the seal chanber 50 (by spring 15) the annular protuberance 211 will move downwardly against the small beads 404 and 405 so that the ink tube and sleeve 40 move together into the seal chamber 50. After the flange on sleeve 40 strikes against the partition plate 121 inside the pen holder, the sliding sleeve 40 is stopped, while the ink tube 21 continues to move downwardly; the annular protuberance 211 penetrates through the small beads 404 and 405 to retract tube 21 into the seal chamber 50 to the position shown in FIG. 3.

According to the present invention, the ink tube 21 can be moved in and out between the FIG. 1 and FIG. 3 positions by simply turning the rear cap 13 without removing the front pen socket 11. Sleeve 40 acts as a shield between the writing nib on tube 21 and the sealing disks 311, 312 and 313, such that the nib never comes in contact with the disks.

I claim:

1. A writing pen comprising an elongated tubular pen holder (11, 12) having a nib-accommodation hole (111) at one end thereof, an internal shoulder (114) spaced axially from said hole, and a partition (121) spaced axially from said shoulder remote from said hole; an ink cartridge assembly slidably arranged within said tubular pen holder, said ink cartridge assembly including an ink tube (21) terminating in a writing nib, said ink tube having an annular protuberance (211) spaced axially from the writing nib; an apertured seal means (31) located within said pen holder in the space between said hole and said internal shoulder (114); said seal means comprising a plural number of deflectable sealing disks having transverse slits extending therethrough, the slits in adjacent ones of the disks being non-aligned in the circumferential direction so that when the disks are in undeflected conditions the seal means is substantially closed against air flow through the slits; a sleeve (40) having an outwardly extending flange and a plural number of internal deflectable gripper elements (404,405); said sleeve being slidably positioned on said ink tube with its flange arranged between said partition (121) and said internal shoulder (114); a single spring (15) trained between said partition and the ink cartridge assembly to normally maintain the ink tube in a retracted position wherein its annular protuberance (211) is in near proximity to said partition, and its writing nib is located within the space circumscribed by said sleeve (40); said sleeve having its flange engaged with the partition when the ink tube is in a retracted position; and means (13,131,132) for normally advancing said ink cartridge assembly to a writing position wherein the writing nib is located outside the pen holder, and said sleeve has its flange engaged against said internal shoulder (114); the deflectable gripper elements being engageable with said annular protuberance so that when the cartridge assembly is being advanced to the writing position the protuberance will act on the gripper elements to drive the sleeve through the slits in the deflectable disks before the writing nib can come in contact with the disks; the deflectability of the gripper elements being such that when the sleeve flange strikes the internal shoulder the protuberance on the ink tube will deflect the gripper elements to move the ink tube through the sleeve.

2. The writing pen of claim 1, wherein the manual advancement means comprises a rotary cap (13) carried on an end of the pen holder remote from said hole, and cam-cam follower means arranged between said cap and said ink cartridge assembly whereby manual rotation of the cap produces axial motion of the ink cartridge assembly.

* * * * *